US012503942B1

(12) United States Patent
Shelander

(10) Patent No.: US 12,503,942 B1
(45) Date of Patent: Dec. 23, 2025

(54) SINGLE SLIDING VANE ROTARY DISPLACEMENT PUMP

(71) Applicant: Ace Machine Design Inc., Commerce, CA (US)

(72) Inventor: Agustus Shelander, Joshua Tree, CA (US)

(73) Assignee: Ace Machine Design Inc., Commerce, CA (US)

( * ) Notice: Subject to any disclaimer, the term of this patent is extended or adjusted under 35 U.S.C. 154(b) by 0 days.

(21) Appl. No.: 18/987,978

(22) Filed: Dec. 19, 2024

Related U.S. Application Data

(60) Provisional application No. 63/612,078, filed on Dec. 19, 2023.

(51) Int. Cl.
*F01C 21/08* (2006.01)
*F01C 1/344* (2006.01)
*F04C 2/344* (2006.01)

(52) U.S. Cl.
CPC ..... *F01C 21/0809* (2013.01); *F01C 1/3441* (2013.01); *F04C 2/3441* (2013.01); *F04C 2240/10* (2013.01); *F04C 2240/30* (2013.01); *F04C 2250/30* (2013.01)

(58) Field of Classification Search
CPC .. F01C 21/0809; F01C 1/3441; F04C 2/3441; F04C 2240/10; F04C 2240/30; F04C 2250/03
See application file for complete search history.

(56) References Cited

U.S. PATENT DOCUMENTS 2,397,098 A * 3/1946 Fowler ..... F04C 2/3441 418/150
2,491,351 A * 12/1949 Zeitlin ..... F04C 2/3441 418/150
4,419,059 A * 12/1983 Anderson ..... F04C 18/3441 418/150
4,484,873 A * 11/1984 Inagaki ..... F04C 18/3441 418/150
4,616,984 A * 10/1986 Inagaki ..... F04C 18/3441 418/150

(Continued)

FOREIGN PATENT DOCUMENTS

CN 101509487 A 8/2009
CN 105090726 A 11/2015

(Continued)

*Primary Examiner* — Mary A Davis
(74) *Attorney, Agent, or Firm* — Canady & Lortz LLP; Bradley K. Lortz

(57) ABSTRACT

A sliding vane rotary pump apparatus embodiment of the invention has a stator having a bore with a wall, a rotor having a central axis about which the rotor rotates within the bore, and a vane comprising a single piece that includes two opposed tip regions that each have a contact point where the vane contacts the wall of the bore of the stator. The vane has a centroid that follows an eccentric circular path as the vane slidably moves within the rotor as the rotor rotates and induces the vane to slidably move within the rotor from contacting the wall of the bore at the contact point of the two opposed tip regions. The vane can have a constant thickness along its length until the two opposed tip regions at each end and the two opposed tip regions can be circular each having a common constant vane tip radius.

12 Claims, 10 Drawing Sheets

(56) References Cited

U.S. PATENT DOCUMENTS

| | | | | | |
|---|---|---|---|---|---|
| 5,713,210 | A * | 2/1998 | Jirnov | F01C 21/0809 | 62/402 |
| 6,236,897 | B1 * | 5/2001 | Lee | F04C 18/3441 | 700/67 |
| 11,306,718 | B2 * | 4/2022 | Suzuki | F04C 18/3441 | |

FOREIGN PATENT DOCUMENTS

| | | | | | |
|---|---|---|---|---|---|
| CN | 105864034 | A | | 8/2016 | |
| CN | 205677824 | U | | 11/2016 | |
| GB | 1065646 | A | * | 4/1967 | F01C 1/3441 |

* cited by examiner

SINGLE SLIDING VANE ROTARY DISPLACEMENT PUMP

CROSS-REFERENCE TO RELATED APPLICATIONS

This application claims the benefit under 35 U.S.C. § 119 (e) of the following U.S. provisional patent application, which is incorporated by reference herein:

U.S. Provisional Patent Application No. 63/612,078, filed Dec. 19, 2023, and entitled "SINGLE-SLIDING-VANE ROTARY DISPLACEMENT PUMP," by Shelander.

FIELD OF THE INVENTION

This invention relates to sliding vane rotary displacement pumps. Particularly, this invention relates to sliding vane rotary displacement pumps using a bore having an eccentric shape.

BACKGROUND

Sliding vane rotary displacement pumps are common and efficient devices for pumping fluid. However, because the vanes of the pump operate within a circular bore in a rotor that is offset from the center of the bore, there must be allowance for the vanes to extend and retract from rotor. This is most commonly achieved by splitting the vane into two or more segments that extend and retract from opposing sides of the rotor independently. Consequently, these vane segments then require additional means to maintain contact with the bore wall. Typically, springs, hydraulic porting, or centrifugal force from the rotor motion can be employed to ensure contact between the vane segments and the bore wall. However, the use of vane segments limits the allowable eccentricity of the rotor because the slots in the rotor must support short vane segments. Some prior art sliding vane rotary displacement pumps are described hereafter.

Chinese Patent Application No. CN101509487A, published Aug. 19, 2009, discloses a non-circular stator internal ring curve single-acting vane pump belongs to the field of mechanical design in mechanical engineering, which is a hydraulic pump that the vane is geometrically sealed with the stator and that the vane is tightly jointed with the internal surface of the stator without external force. The stator internal ring curve in the invention is a non-circular closed curve: any straight line is made through the acnode of the non-circular closed curve, the length of the line segment formed by two intersection points of the straight line and the non-circular closed curve is always a definite value, and the polar equation of the non-circular closed curve is as follows: rho equals R plus F (theta); in the formula, rho is polar radius, theta is polar angle, R is constant; and in rectangular coordinate system, F (theta) is continuous periodic function and is symmetrical about the point (phi, 0), the cycle time T is equal to 2 phi, and theta belongs to (0, 2 phi). Compared with the existing vane pump, in the working process of the non-circular stator internal ring curve single-acting vane pump in the invention, the vane radial force is balanced without supplying high pressure oil through the root of the vane groove, that is, oil supply path is not needed; and the pump is simple in structure, and the manufacturing technology is convenient. The non-circular closed curve further can be used for vane hydraulic motors.

Chinese Patent Application No. CN105090726A, published Nov. 25, 2015, discloses a rotating plate type lubricating oil pump. The rotating plate type lubricating oil pump comprises a shell (1), a stator (2), a transmission shaft (3) and a rotating plate (4). The inner cavity curve of the stator (2) is a 360-degree circumferential "Shanshi curve" with the axis point of the rotating shaft (3) as the center, and the "Shanshi curve" is in axial symmetry. The sum of the curve radius at any angle and the curve radius distanced from the curve radius by 180 degrees is a fixed value. The curve characteristic guarantees that length-fixed blades will not be blocked when rotating in the cavity of the stator. The rotating plate type lubricating oil pump effectively avoids gas corrosion damage and has the beneficial effects of being simple in structure, stable in pressure, good in using reliability and the like.

Chinese Patent Application No. CN105864034A, published Aug. 17, 2016, discloses a single-sliding-vane rotary displacement pump which comprises cavity clamping plates, a power shaft, a stator, a rotor and a sliding vane, wherein the axis of the power shaft is a rotating axis, the cross section of a stator cavity is perpendicular to the rotating axis, the rotor is bias arranged in the stator cavity and is tangent with the stator cavity, a cross-section inner circling curve of the stator is formed by using any one point on the rotating axis passing by the stator cavity as an original point and establishing smooth transitional connection of all points in a rectangular coordinate system on a plane perpendicular to the rotating axis, the coordinate system divides the plane into four quadrants, the bottom surface radius of the rotor is R, the length of the sliding vane is 2S, an included angle is t, the t ranges from 0 to 90, and the points are obtained through a calculation formula. The length of a line section formed by any straight line passing by the original point and perpendicular to the rotating axis and two intersection points of the inner circling curve is always equal to the length of the sliding vane. By the adoption of the technical scheme, the single-sliding-vane rotary displacement pump has the advantages of being simple in manufacturing process, low in cost, good in sealing performance and suitable for high-speed and low-speed operation.

Chinese Patent Application No. CN205677824U, published Nov. 9, 2016, discloses a kind of single sliding vane rotary displacement pump, including cavity volume clamping plate, line shaft, stator, rotor, slide plate, the axis of line shaft is rotation axis, the cross section of stator cavity volume is vertical with rotation axis, rotor biasing stator cavity volume in and tangent with it, the polar equation of the closed curve of described reservation shape is: $\rho(t)=S(S R)*\cos(t)$, described polar limit is any point on the rotation axis in described stator cavity volume of learning from else's experience, described polar face is perpendicular to rotation axis, all through limit and be perpendicular to the line segment length that any straight line of rotation axis and two intersection points of inner loop curve are formed and be always the length of slide plate. Technical solutions of the utility model, manufacturing process is simple, low cost, good seal, be suitable for the technique effect of high low-speed running to make pump have.

In view of the foregoing, there is need in the art for sliding vane rotary displacement pumps using a bore having an eccentric shape that are inexpensive to manufacture and well performing. These and other needs are met by the embodiments of the invention described herein.

SUMMARY OF THE INVENTION

A sliding vane rotary pump apparatus embodiment of the invention has a stator having a bore with a bore wall, a rotor having a central axis about which the rotor rotates within the bore and a slot through the central axis, and a vane comprising a single piece and slidably within the slot of the rotor, the vane having two opposed tip regions that each have a contact point where the vane contacts the wall of the bore of the stator. The vane has a centroid that follows a circular path as the vane slidably moves within the slot of the rotor as the rotor rotates and induces the vane to slidably move within the slot under contact with the wall of the bore at the contact point of each of the two opposed tip regions. The vane and the bore wall can have a common height and the vane can have a constant thickness along its length until the two opposed tip regions at each end. The rotor can comprise a cylindrical surface with the central axis located within the bore such that the cylindrical surface contacts the bore wall at a point across the narrowest wall to wall measurement of the bore wall.

In further embodiments, the two opposed tip regions are each a circular arc having a common constant vane tip radius. The wall of the bore is defined by an x coordinate of $-(2*re+rR-rT)*\sin(\theta)-re*\sin(2*\theta)$ added to an x radial offset of a circular rotor tip contact and a y coordinate of $(2*re+rR-rT)*\cos(\theta)+re*\cos(2*\theta)$ added to a y radial offset of the circular rotor tip contact, where re is a selected radius of eccentricity, rR is a rotor radius, rT is the common constant vane tip radius and $\theta$ is an angular position of the rotor swept through 360 degrees.

Typically, a fluid can be forced by the vane from an inlet in the wall of the bore to an outlet in the wall of the bore as the rotor rotates and drives the vane. A complete rotation of the rotor can correspond to both of the two opposed tip regions forcing fluid to the outlet.

A typical method embodiment of the invention for making a sliding vane rotary pump comprises the steps of producing a stator having a bore with a bore wall, producing a rotor having a slot therethrough, producing a vane having a centroid and two opposed tip regions, slidably engaging the vane into the slot of the rotor, and rotatably fixing the rotor and slidably engaged vane into the bore about a central axis of the rotor. The two opposed tip regions of the vane each have a contact point where the vane contacts the wall of the bore of the stator and the vane the centroid follows a circular path as the vane slidably moves within the slot of the rotor as the rotor rotates and induces the vane to slidably move within the slot under contact with the wall of the bore at the contact point of each of the two opposed tip regions. The method embodiment of the invention can be modified consistent with any apparatus embodiment described herein.

BRIEF DESCRIPTION OF THE DRAWINGS

Referring now to the drawings in which like reference numbers represent corresponding parts throughout.

DETAILED DESCRIPTION OF THE INVENTION

1. Overview

The present invention allows for a practical single-piece vane that maintains close contact with the stator bore having non-circular geometry. In particular, the bore is represented by a curve that is swept by a vane with a constant thickness along its length and a tip having a fixed radius. The curve of the bore is continuous, and has a continuous and finite differential, thus making for smooth motion and practical construction. Previous attempts at this style of pump have typically either used vanes having piecewise functions or tapering thin point-like contact tips.

2. Exemplary Sliding Vane Rotary Pump

Figure 1A:
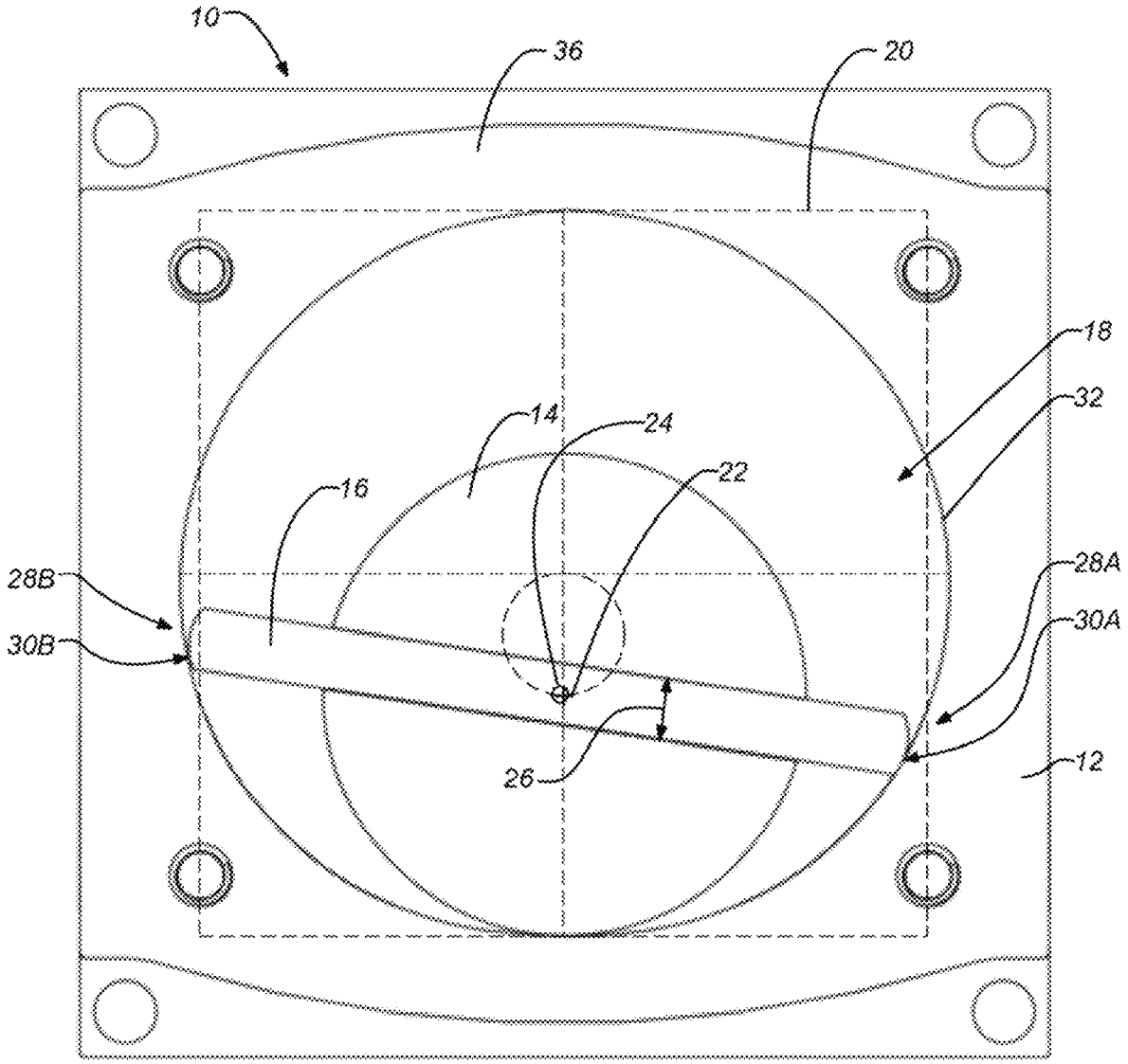
FIG. 1A is a schematic view of an exemplary sliding vane rotary pump embodiment of the invention showing the relationship between the rotor, bore and single vane.

FIG. 1A is a schematic view of a sliding vane rotary pump 10 in accord with the present invention. The sliding vane rotary pump 10 includes a stator 12, a rotor 14, and a vane 16. The stator 12 is integral to the pump housing 36 and is typically machined directly into the housing 36. The stator 12 has a bore 18 with a stator wall 32 having an unconventional non-circular curve. This non-circular aspect can be seen by comparing the relative vertical and horizontal dimensions of a square dashed-box 20 superimposed onto FIG. 1A to emphasize this. The square dashed-box 20 has a height aligned with the height of the bore 18 but the identical width of the square dashed-box 20 is shorter than the width of the bore 18. Accordingly, the stator wall 32 has a non-circular shape with a width greater than a height. Note that the height of the bore 18 is measured from a point of contact on the stator wall 32 with the rotor 14 directly through the center of the bore 18 (and also through the center of rotation of the rotor 14 which is eccentric within the bore 18) to a point on the opposite side of the stator wall 32. The dashed line of the height measurement also bisects the superimposed square dashed-box 20 as shown. In addition, the width of the bore 18 is measured perpendicular to and through the midpoint of the height of the bore 18. The dashed line of the width measurement also bisects the superimposed square dashed-box 20 as shown. The intersection of the dashed lines of the height and width measurements occurs at the center of the bore 18.

Typically, the stator wall 32 of the bore 18 has a constant height measured parallel with the central axis 22 of the rotor 14. Accordingly, an interior volume of the pump 10 is formed between the stator wall 32 and the rotor 14 bounded by two sidewalls enclosing the volume perpendicular to the rotor axis. The sidewalls can be made from separate planar surfaces that can be sandwiched onto opposing sides of the bore 18 to enclose the interior volume. Alternately, the bore 18 and one sidewall can be produced together with the bore 18 machined to a fixed depth into a solid material such that the sidewall is the bottom of the bore 18. In this case, the other sidewall with a planar surface is bolted over the bore to close out the interior volume. This is best illustrated in FIG. 1D described hereafter.

The rotor 14 within the bore 18 is circular and rotates about a central axis 22 (depicted with a "+" symbol and shown more clearly in FIGS. 2A-2F) and slotted to slidably support the vane 16 within the slot. The central axis 22 of the rotor 14 is positioned at a location eccentric within the bore 18 such that there is a point of contact between the rotor 14 and the stator wall 32. Notably, the point of contact in the embodiment shown occurs at the narrowest wall to wall measurement across the bore as illustrated by the height of the square dashed-box 20 in FIG. 1A contrasted with the width of the bore being wider than the width of the square dashed-box 20. The roles of the rotor 14 are to rotate and to support the vane 16, in largely conventional manner. Typically, the rotor 14 is made to rotate about the central axis 22 by being supported on a shaft through the central axis 22. The rotor 14 can be suitably supported on bushings or bearings on the shaft depending upon the application as will be understood by those skilled in the art.

The vane 16 has particular features that afford the advantages of the present invention. One such unconventional feature for embodiments of the present invention is that the vane 16 can be a single element rather than a vane formed from separate segments as with most conventional sliding vane rotary pumps. Accordingly, the vane 16 within the rotor 14 of the present invention does not extend and retract independently from the rotor 14 in the manner of conventional segmented vanes. Thus, the single vane 16 does not require the additional elements for extension and retraction such as springs, hydraulic porting, or centrifugal force used in many conventional sliding vane rotary pumps. The vane 16 has a centroid 24 (depicted with a "o" symbol also shown more clearly in FIGS. 2A-2F). The central axis 22 of the rotor 14 and the centroid 24 of the vane 16 almost overlap in FIG. 1A.

A second feature of the vane 16 for embodiments of the invention is that it can have a constant thickness (depicted by arrowed-line 26) along its length until the circular arc tips. This differs from many conventional vanes that employ vanes which taper to thin point-like tips. Note also that the center of the slot in the rotor 14 passes directly through the central axis 22 of the rotor 14 and matches the constant thickness of the vane 16 to support it with a slidable engagement. The height of the slot also matches the height of the bore wall 32 so that the vane 16 wipes through the full volume of the bore. The constant thickness can be selected based upon the particular application as will be understood by those skilled in the art.

A third feature of the vane 16 for embodiments of the invention is that it can have a constant tip radius, i.e. the tip end is circular. Equidistant from the centroid 24 the vane 16 has tip regions 28A, 28B that each include a respective contact points 30A, 30B where the vane 16 contacts the bore 18 of the stator 12.

Figure 1B:
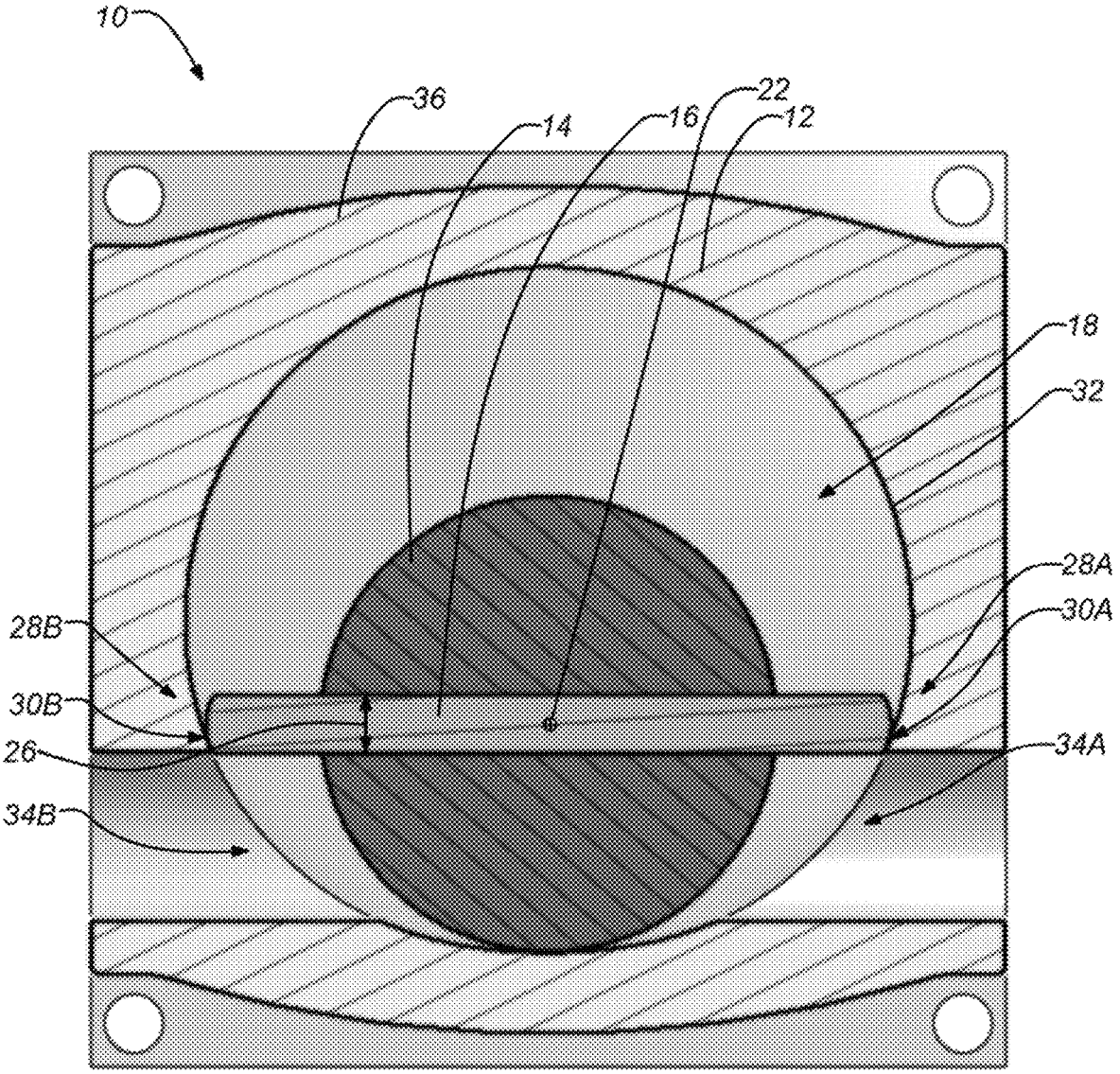
FIG. 1B is a cross section view perpendicular to the rotor axis of an exemplary sliding vane rotary pump embodiment of the invention showing the inlet and outlet ports.

FIG. 1B is a cross section view perpendicular to the rotor axis 22 of an exemplary sliding vane rotary pump 10 embodiment of the invention showing the inlet and outlet ports 34A, 34B. Under counterclockwise rotation of the rotor 14 as shown movement of the vane 16 having constant thickness (depicted by arrowed-line 26) will cause the tips 28A, 28B to wipe around the stator wall 32 passing across the inlet port 34A to the outlet port 34B. As fluid enters the inlet port 34A, the movement of the vane 16 within the bore 18 forces the fluid from the inlet port 34A to the outlet port 34B. It should be noted that the pump 10 can be operated in reverse such that movement of the rotor 14 and vane 16 in a clockwise direction will result in the outlet port 34B becoming the inlet and the inlet port 34A becoming the outlet.

Figure 1C:
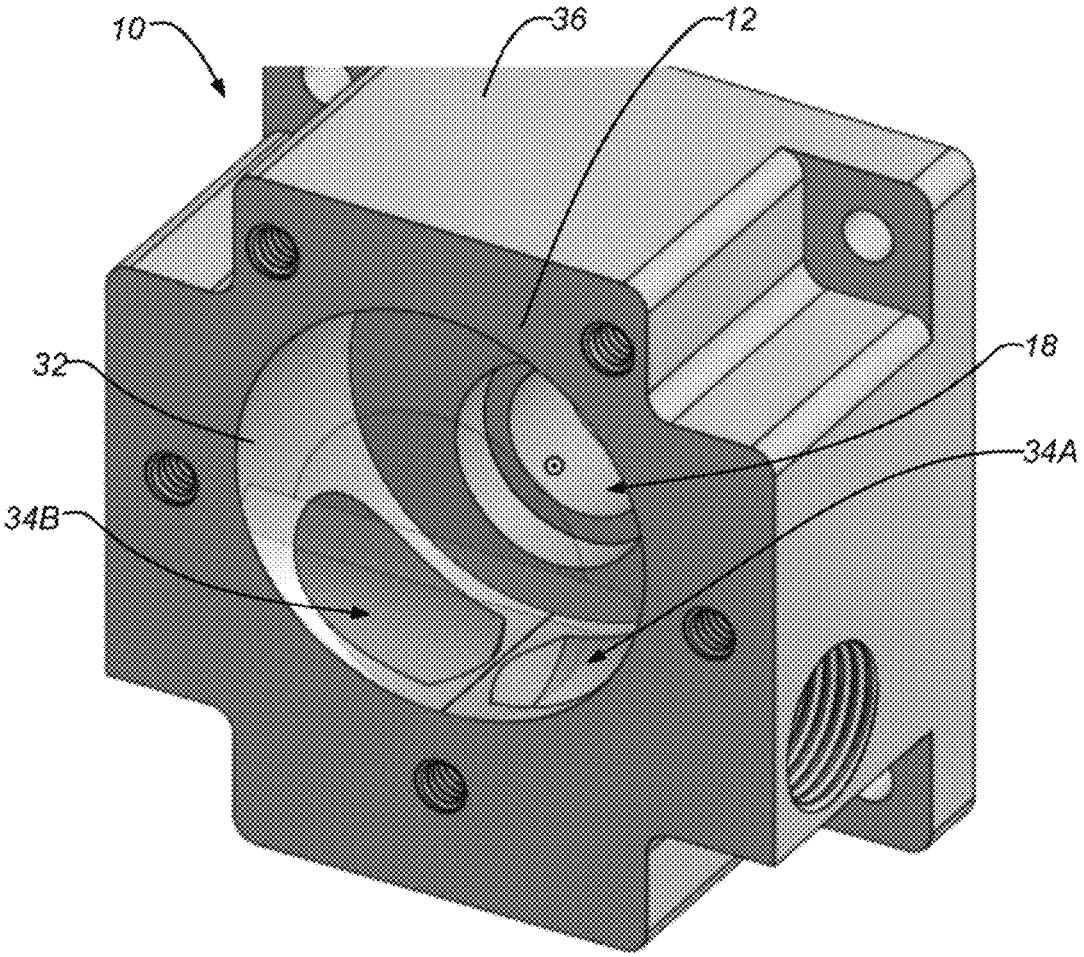
FIG. 1C is a right side perspective view of a pump housing for an exemplary sliding vane rotary pump embodiment of the invention showing the inlet and outlet ports.
Figure 1D:
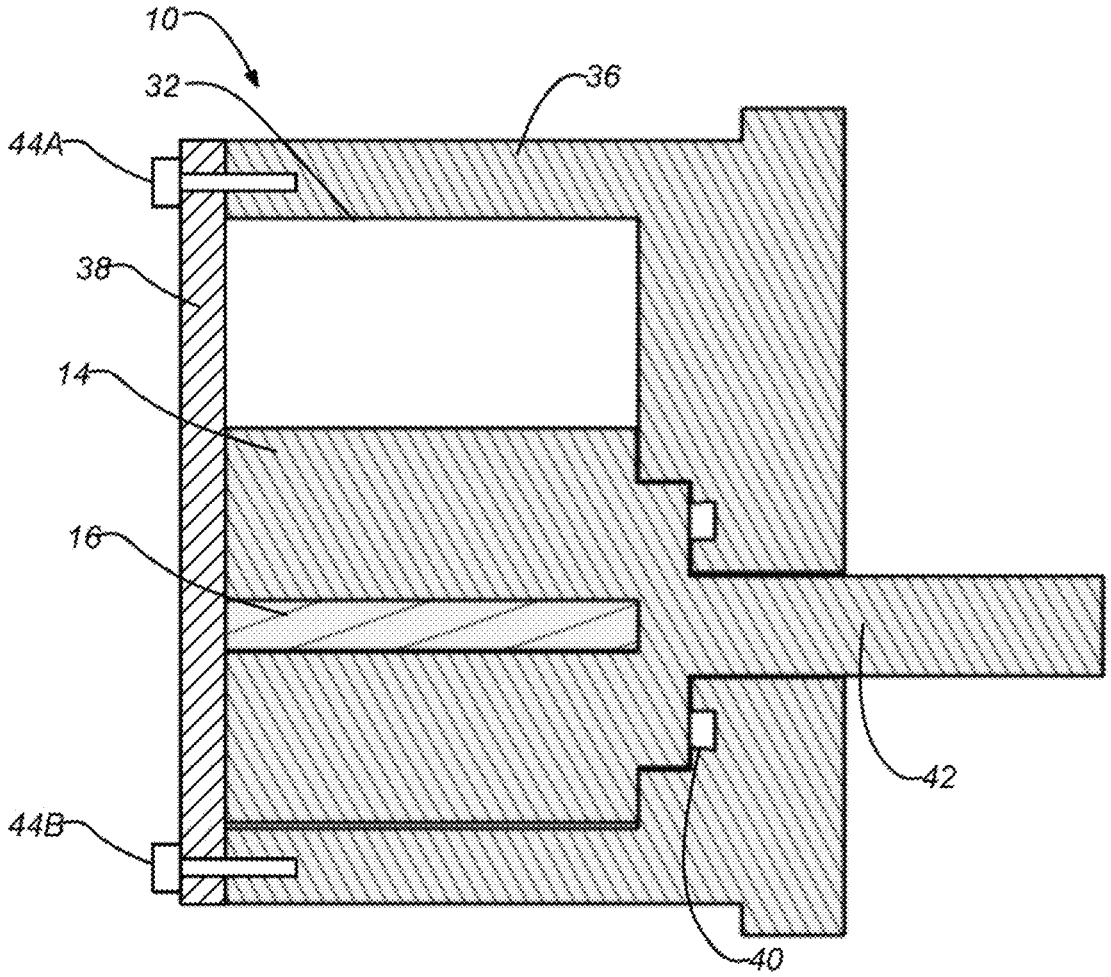
FIG. 1D is a cross section view parallel to the rotor axis of a pump housing for an exemplary sliding vane rotary pump embodiment of the invention showing the vane and rotor sealed and coupled to a drive shaft.

FIG. 1C is a right side perspective view of a pump housing for an exemplary sliding vane rotary pump 10 embodiment of the invention showing the inlet and outlet ports 34A, 34B. This view shows the ports 34A, 34B intersecting the bore wall 32. The rotor 14 and vane 16 are not shown to provide a clear view of the ports 34A, 34B. Note that although there are some superficial differences in the outer envelope of the pump housing 36 depicted in FIG. 1C and the remaining figures, those skilled in the art will appreciate that all the functional elements are identical.

FIG. 1D is a cross section view parallel to the rotor axis 22 of a pump housing 36 for an exemplary sliding vane rotary pump 10 embodiment of the invention showing the vane 16 and rotor 14 sealed and coupled to a drive shaft 42. Although the drive shaft 42 is shown integrated with the rotor 14, those skilled in the art will appreciate that these elements can be separately constructed and coupled together with a spline, threaded joint or any other suitable know technique for joining a drive shaft and a driven element. The rear seal 40 for the pump can be an o-ring or similar seal disposed in an annular groove around the hole in the housing 36 for the drive shaft 42. The front of the pump 10 can be enclosed by a front plate 38 which can be affixed to the housing 36 to enclose the bore 18 with threaded fasteners (not shown) or any other suitable known means. In addition, the front plate 38 and housing 36 interface can be sealed using a gasket, o-ring or any other suitable known means for sealing a pump volume. Also shown are bolts 44A, 44B securing the front plate 38 to threaded holes in the housing 36.

Figure 2A:
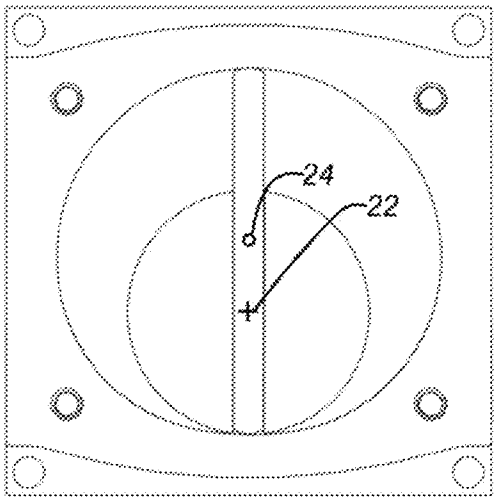
FIGS. 2A-2F are a series of views of the sliding vane rotary pump in FIG. 1 illustrating motion of the rotor and the vane rotating within the stator.
Figure 2B:
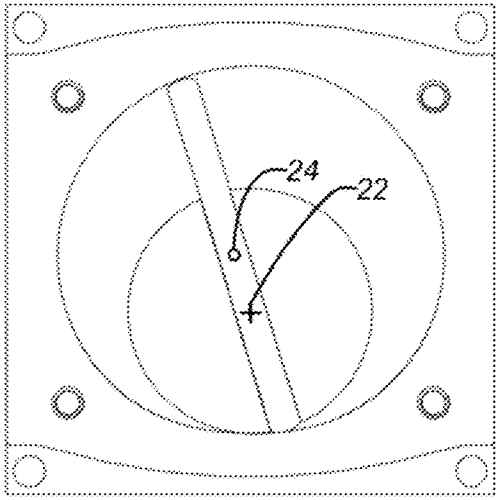
Figure 2C:
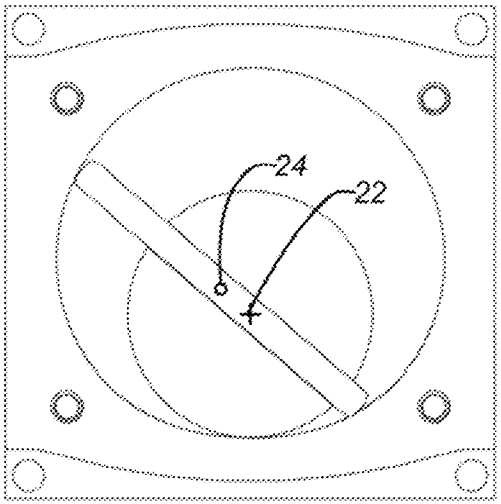
Figure 2D:
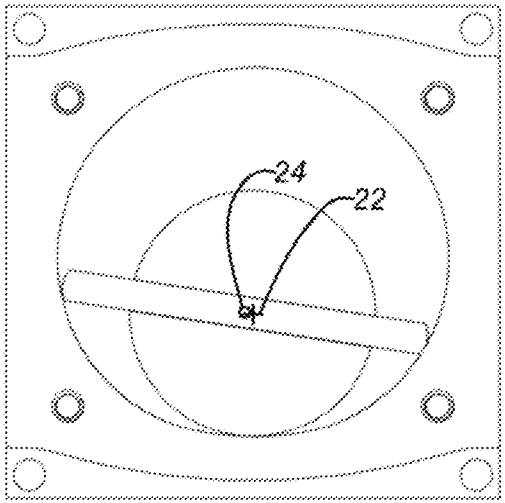
Figure 2E:
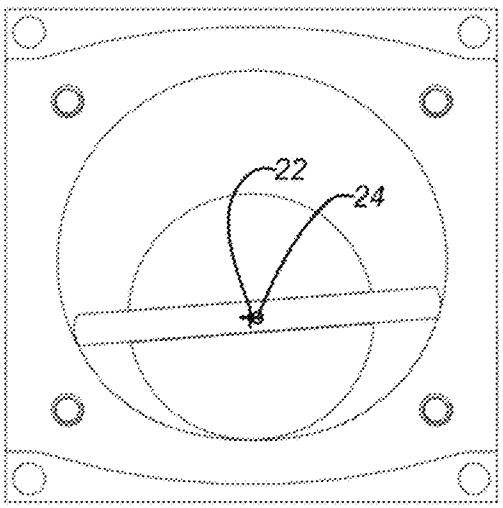
Figure 2F:
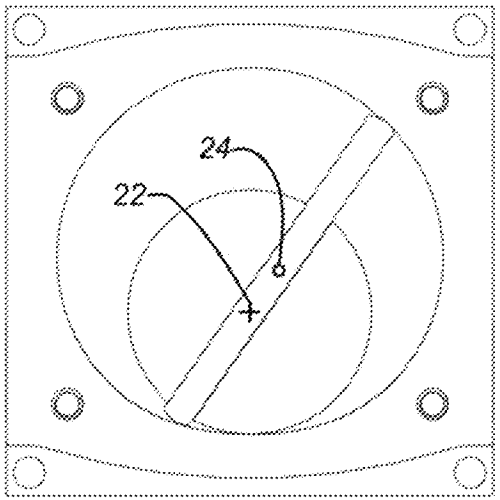

FIGS. 2A-2F are a series of views of the exemplary sliding vane rotary pump 10 of FIG. 1A showing the movement of the rotor 14 as it rotates counterclockwise and the vane 16 movement within the stator 12 as contact with the bore wall 32 causes it to slide within the slot in the rotor 14. The central axis 22 location of the rotor 14 remains fixed, whereas the centroid 24 of the vane 16 moves in a circular path. Starting with the vane 16 in a vertical position as shown in FIG. 2A, the centroid 24 of the vane 16 is directly above and furthest from the central axis 22 of the rotor 14. In FIG. 2B as the rotor 14 and vane 16 begin to turn counterclockwise the centroid 24 moves left and closer to the central axis 22. In FIG. 2C this movement continues counterclockwise and the centroid moves further left and closer toward the central axis 22. As the movement passes between FIGS. 2D and 2E the vane 16 reaches a horizontal position where the centroid 24 becomes aligned with the central axis 22. FIG. 2D shows the centroid 24 just to the left of the central axis 22 and FIG. 2E shows the centroid 24 just to right of the central axis 22. FIG. 2F shows the rotor 14 and vane 16 continuing in a counterclockwise rotation as the vane 16 moves from a horizontal position back to a vertical position (now with the opposite tip now up). As this occurs, the centroid moves to the right of the central axis along a curved path mirroring the curved path of the centroid 24 as the vane 14 was first moved from vertical to horizontal in FIGS. 2A to 2D.

Figure 3A:
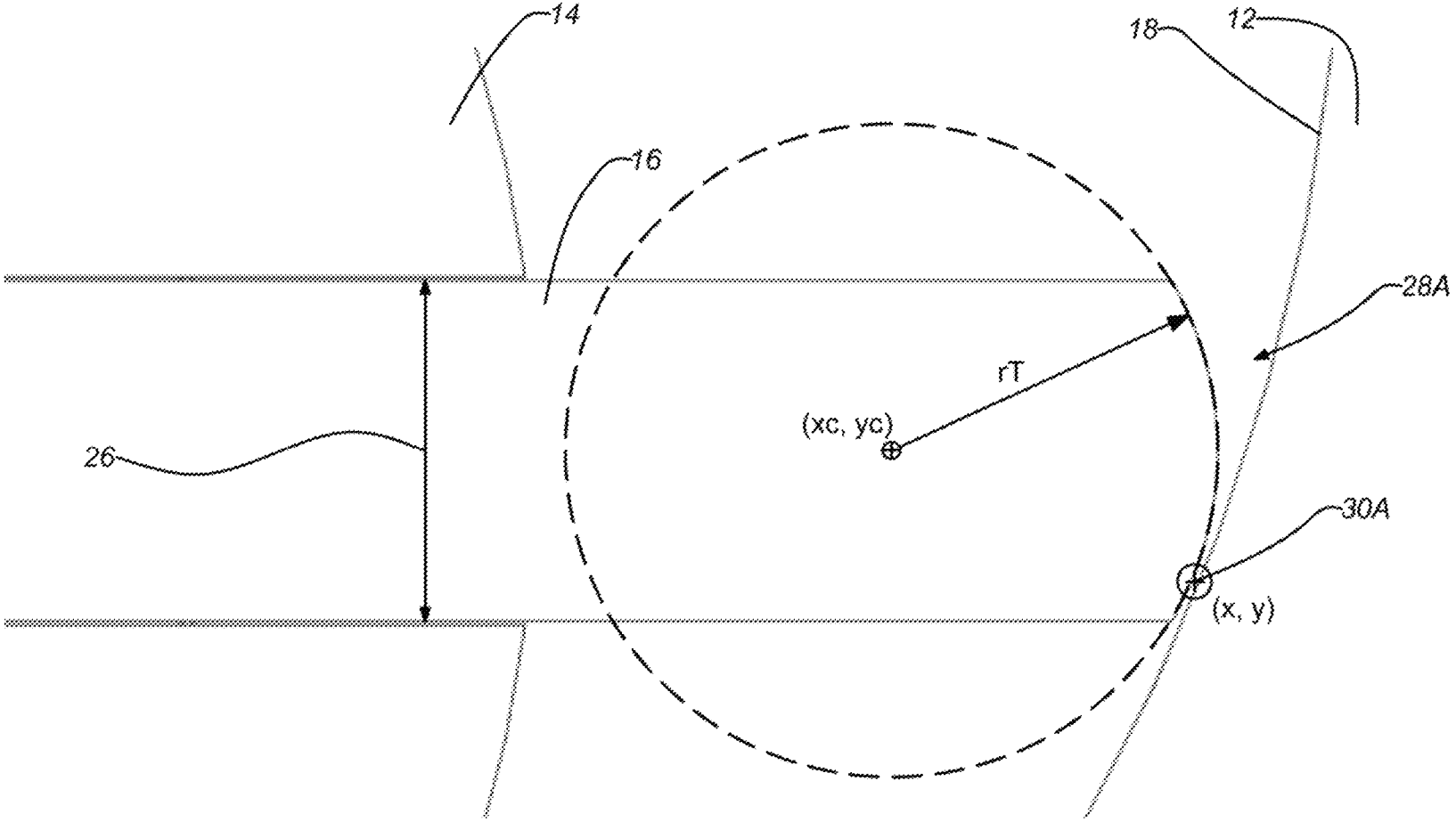
FIG. 3A is a schematic view of the right most contact point of the vane tip engaging with the stator.

FIG. 3A is an enlarged schematic view of the right most contact point 30A (x, y) of the vane 16 engaging with the stator 12. The right most tip region 28A is also shown, including having a finite tip radius (centered at (xc, yc)) and the constant thickness of the vane 16 (depicted by arrowed-line 26). Note that the origin of the defined coordinate system is the central axis 22 of the rotor (not shown to the left).

Figure 3B:
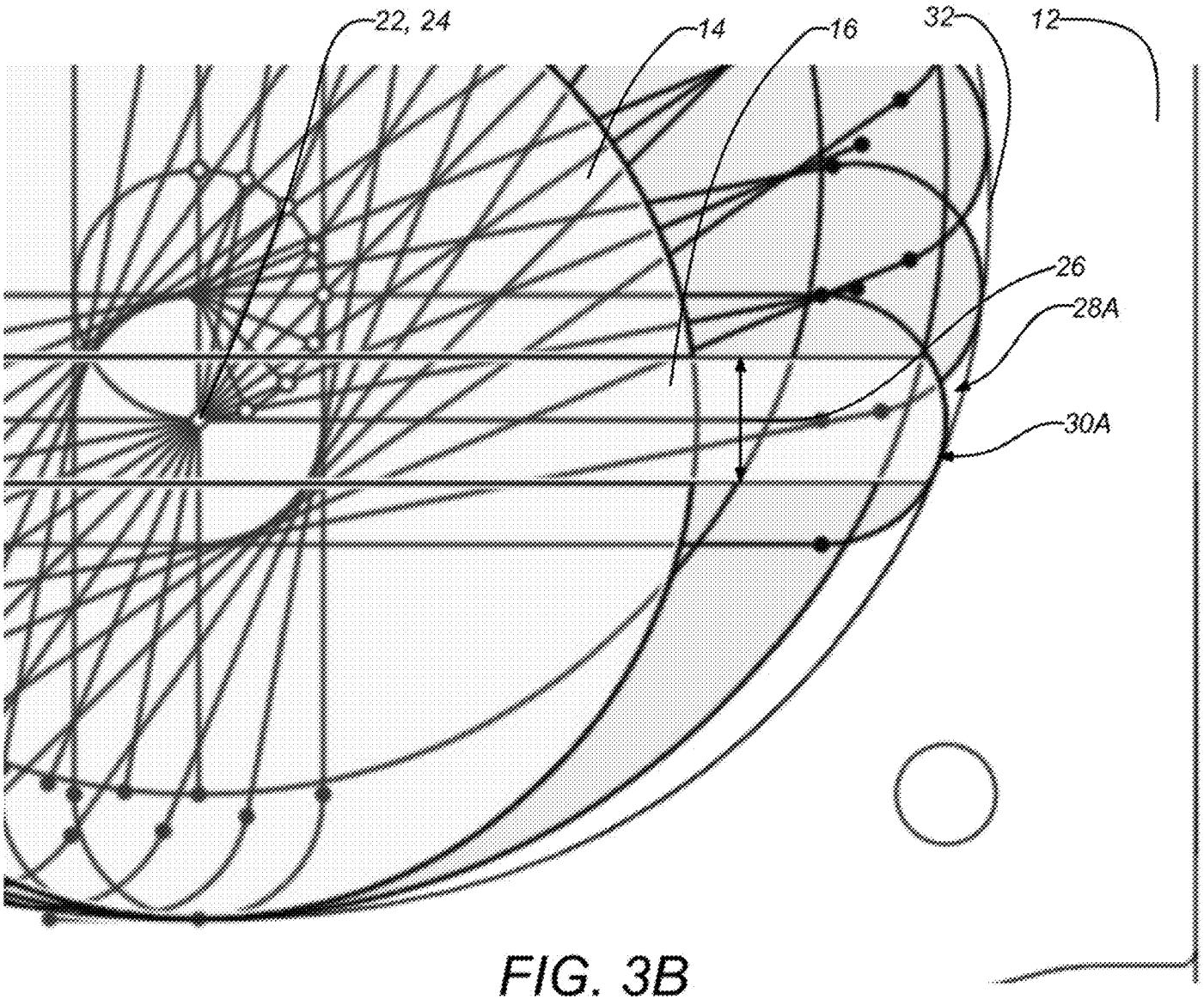
FIG. 3B is a schematic view showing rotor, vane and bore wall geometry of the right most contact point of the vane tip engaging with the stator.
Figure 3C:
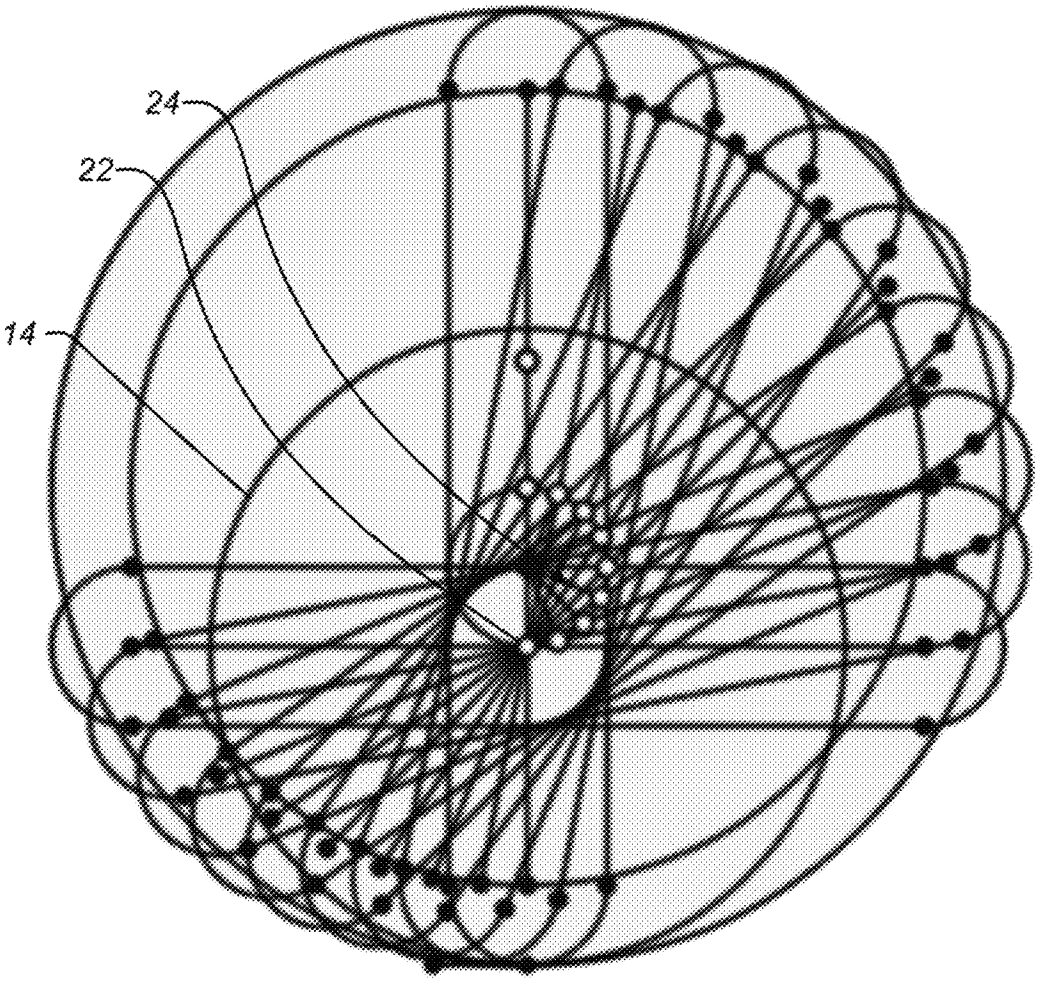
FIG. 3D is a schematic view showing rotor, vane and bore wall geometry and motion from a horizontal to vertical vane position.

FIG. 3B is a close up schematic view showing rotor 14, vane 16 and bore wall 32 geometry of the right most contact point 30A of the vane tip 28A engaging with the stator 12. FIG. 3C shows a sequence of positions of the geometry of the vane 16 superimposed as it rotates counterclockwise with the rotor 14. Notably in the first position, showing the vane 16 in a horizontal position with constant thickness (depicted by arrowed-line 26), the vane centroid 24 and the central axis 22 of the rotor 14 are coincident. However, as the rotor 14 and vane 16 rotate, the vane centroid 24 moves in a circular path illustrated by the series of "o" symbols beginning from the central axis 22.

Figure 3D:
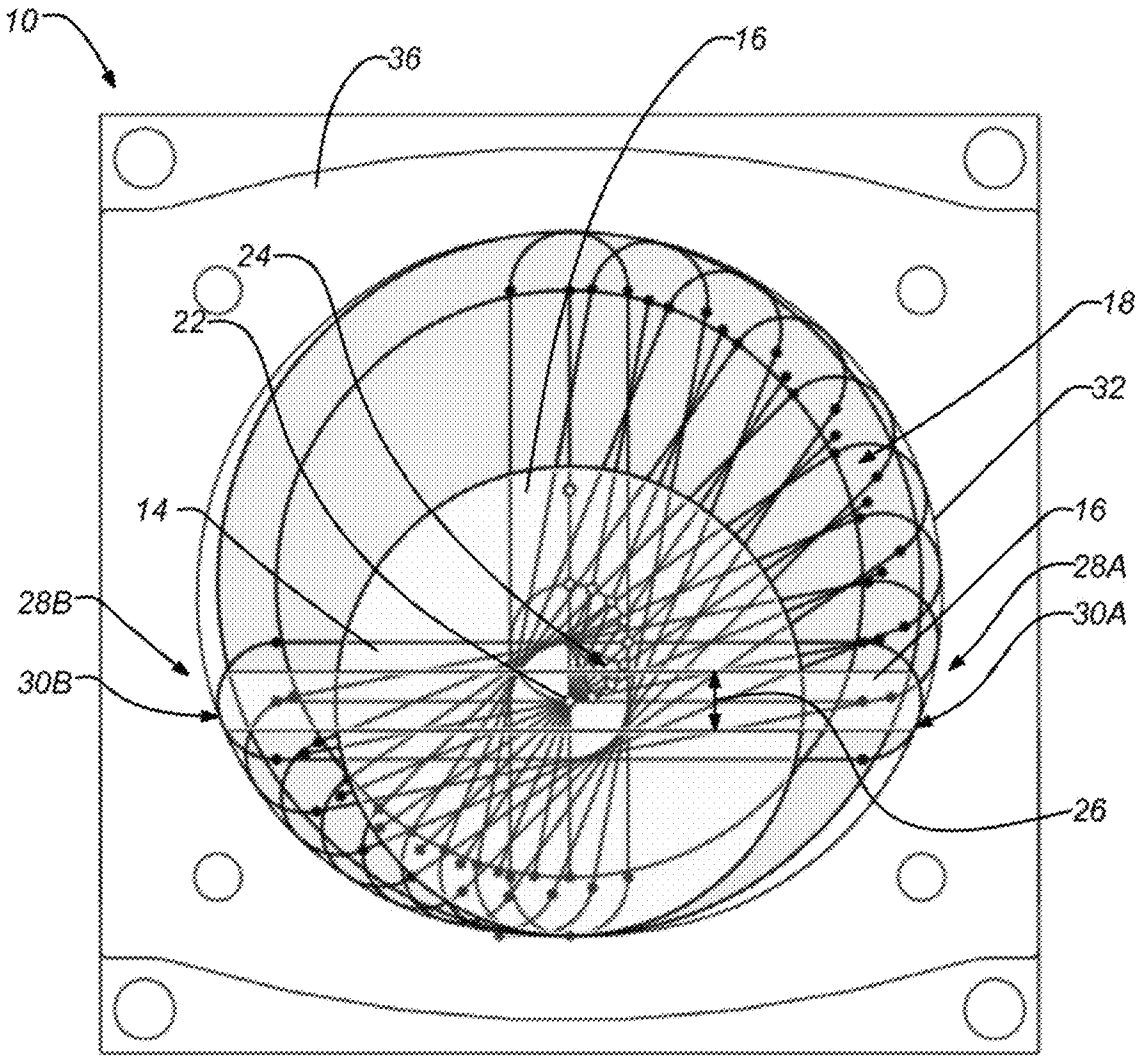

FIG. 3D is a wider schematic view showing rotor 14, vane 16 and bore wall 32 geometry and motion from a horizontal to vertical vane position. As shown, motion of the rotor 14 and vane 16 from a horizontal vane position to a vertical vane position across 90 degrees of rotation causes the vane centroid 24 to move along 180 degrees of a circular path beginning from the central axis 22 to the top of the circular path directly above the location of the central axis 22. The symmetry of the rotor 14 and vane 16 causes only another 90 degree rotation (totally just 180 degrees) to correspond to a complete 360 degree circular path of the vane centroid 24; the centroid fully circles with every half turn of the rotor 14 and vane 16.

Sliding vane rotary pump embodiments of the invention can be implemented using any suitable drive motor depending upon the application, e.g. the desired flow rate and viscosity of the working fluid as will be understood by those skilled in the art. Typically, an electric motor of any suitable type can be employed and using any suitable electrical source, e.g. AC or DC power.

3. Ideal Stator Surface

The relationship and interoperation of the rotor, vane and bore wall shown in FIG. 3 can be defined by a set of equations. The following equations describe the ideal stator surface for a vane that has circular tips and a centroid that follows a circular path according to an embodiment of the invention. The pump can be defined by any reasonable selection of radius, rotor diameter, and eccentricity (radius of circle that the vane centroid follows) as will be understood by those skilled in the art. These equations describe the ideal surface of the bore 18 (i.e. the bore wall) for the stator 12 with a vane 16 that has circular tip regions 28A, 28B and a centroid 24 that follows a circular path. The sliding vane rotary pump 10 is defined by any suitable selection of tip radius, rotor diameter, and eccentricity (radius of the circle that the vane centroid follows) as will be understood by those skilled in the art.

The curve of the stator or bore wall is defined by the following variables and equations. The origin of the coordinate system is defined at the central axis of the rotor.

- x is the x coordinate of a point on the curve of the wall of the bore.
- y is the y coordinate of a point on the curve of the wall of the bore
- θ is the angular position of the rotor (measured clockwise starting from vertical)
- xc is the x coordinate of the center of the circle defining the vane tip
- yc is the y coordinate of the center of the circle defining the vane tip
- xt is the x offset from the center of the circle defining the rotor tip to the contact point of the vane and stator
- yt is the y offset from the center of the circle defining the rotor tip to the contact point of the vane and stator
- rR is the radius of the rotor (a user-defined design constant)
- re is the radius of eccentricity (a user-defined design constant), i.e. the radius of the circle made by the movement of the centroid of the vane
- IT is the radius of vane tip (a user-defined design constant)
- ϕ is the angular position of the point of contact between the vane tip and the bore wall $$x = xc + xt \tag{1}$$

$$Y = yc + yt \tag{2}$$

$$xc = -(2*re + rR - rT)*\sin(\theta) - re*\sin(2*\theta) \tag{3}$$

$$yc = (2*re + rR - rT)*\cos(\theta) + re*\cos(2*\theta) \tag{4}$$

$$xt = -rT*\sin(\phi) \tag{5}$$

$$yt = rT*\cos(\phi) \tag{6}$$

$$\phi = \arctan\left(\frac{rR*\cos(\theta) + 2*re*\cos(2*\theta)}{rR*\sin(\theta) + 2*re*\sin(2*\theta)}\right) \tag{7}$$

The equations above describe a simple practical path for the bore wall using an circular path and circular vane tips; however non-circular paths and non-circular tip geometry are also possible. For example, the eccentric path could be an ellipse and the tip profile could be a section of an ellipse, parabola, or hyperbola. Those skilled in the art will appreciate that these equations can be used to machine the rotor, vane, and bore wall for various embodiments of the invention.

4. Method of Producing a Sliding Vane Rotary Pump

Typically, all elements of an exemplary embodiment of the sliding vane rotary pump can be manufactured from any suitable metal, e.g. aluminum or steel. In one example the stator, rotor, and vane can be conventionally produced as machined aluminum or steel parts and then assembled using appropriately sized off the shelf components, e.g. screws, axles and bushings or bearings. However, embodiments of the invention can also be produced from known plastics, phenolics, composites or any other suitable non-metal material depending upon the application. Furthermore, embodiments of the invention can also be produced using a suitable combination of metal and non-metal components as will be appreciated by those skilled in the art.

Figure 4:
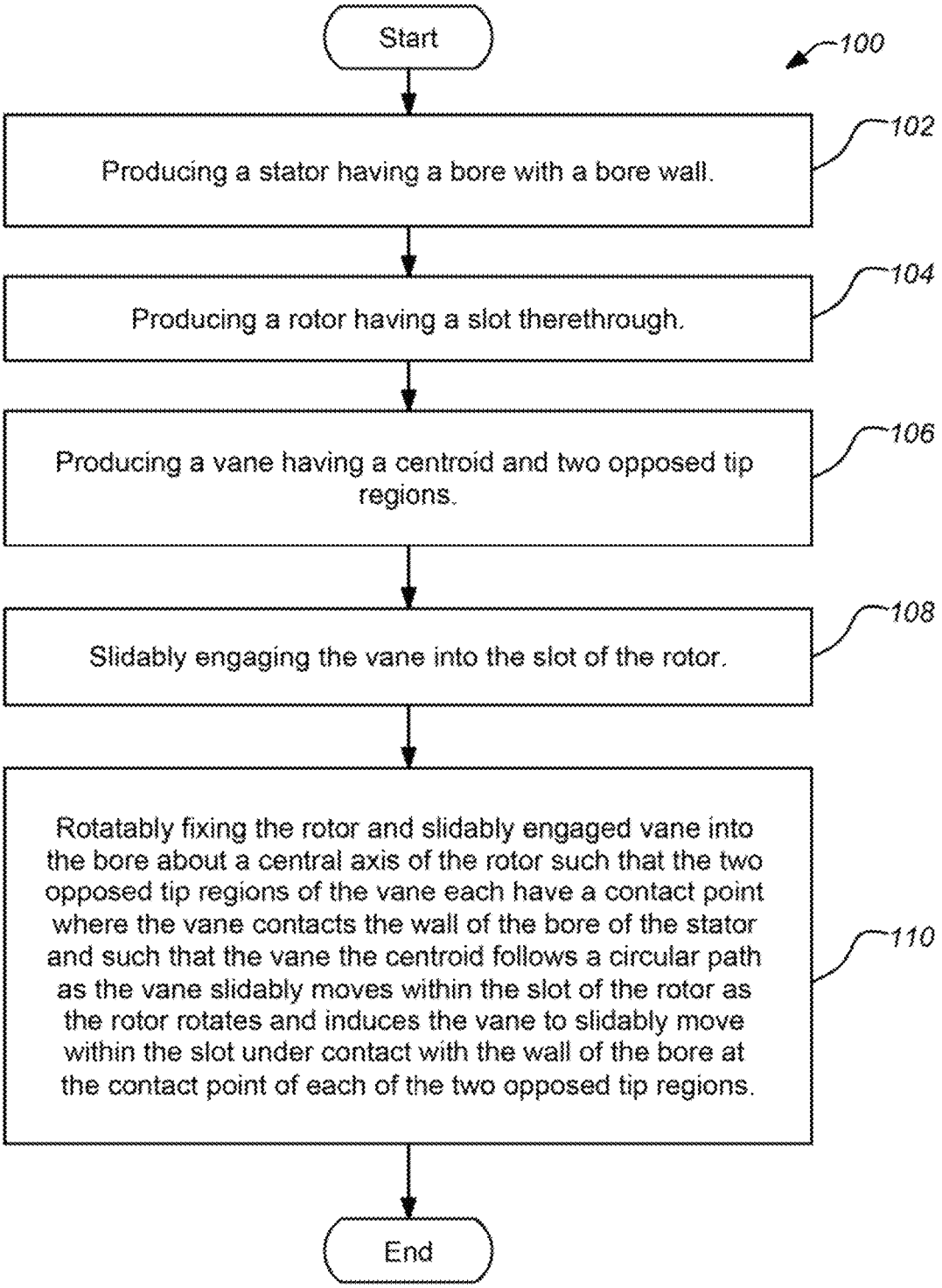
FIG. 4 is a flow chart of an exemplary method embodiment of producing a sliding vane rotary pump.

FIG. 4 is a flowchart showing an exemplary method for producing a sliding vane rotary pump embodiment of the invention. The method 100 for producing a sliding vane rotary pump can include the steps of 102, producing a rotor having a slot therethrough 104, producing a vane having a centroid and two opposed tip regions 106, slidably engaging the vane into the slot of the rotor 108, and rotatably fixing the rotor and slidably engaged vane into the bore about a central axis of the rotor such that the two opposed tip regions of the vane each have a contact point where the vane contacts the wall of the bore of the stator and such that the vane the centroid follows a circular path as the vane slidably moves within the slot of the rotor as the rotor rotates and induces the vane to slidably move within the slot under contact with the wall of the bore at the contact point of each of the two opposed tip regions 110. This method 100 can be further modified consistent with any of the apparatus embodiments of the invention described herein.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. A sliding vane rotary pump apparatus comprising:

a stator having a bore with a bore wall;

a rotor having a central axis about which the rotor rotates within the bore and a slot through the central axis; and a vane comprising a single piece and slidably within the slot of the rotor, the vane having two opposed tip regions that each have a contact point where the vane contacts the wall of the bore of the stator;

wherein the vane has a centroid that follows a circular path as the vane slidably moves within the slot of the rotor as the rotor rotates and induces the vane to slidably move within the slot under contact with the wall of the bore at the contact point of each of the two opposed tip regions;

wherein the two opposed tip regions are each a circular are having a common constant vane tip radius;

wherein the bore wall is defined by an x coordinate of $-(2*re+rR-rT)*\sin(\theta)-re*\sin(2*\theta)$ from the central axis added to an x radial offset of a circular rotor tip contact and a y coordinate of $(2*re+rR-rT)*\cos(\theta)+re*\cos(2*\theta)$ from the central axis added to a y radial offset of the circular rotor tip contact; and wherein re is a selected radius of eccentricity, rR is a rotor radius, rT is the common constant vane tip radius and $\theta$ is an angular position of the rotor swept through 360 degrees.

2. The apparatus of claim 1, wherein the vane and the bore wall have a common height.

3. The apparatus of claim 1, wherein the vane has a constant thickness along its length until the two opposed tip regions at each end.

4. The apparatus of claim 1, wherein the rotor comprises a cylindrical surface with the central axis located within the bore such that the cylindrical surface contacts the bore wall at a point across the narrowest wall to wall measurement of the bore wall.

5. The apparatus of claim 1, wherein a fluid is forced by the vane from an inlet in the wall of the bore to an outlet in the wall of the bore as the rotor rotates and drives the vane.

6. The apparatus of claim 5, wherein a complete rotation of the rotor corresponds to both of the two opposed tip regions forcing fluid to the outlet.

7. A method of making a sliding vane rotary pump comprising the steps of:

producing a stator having a bore with a bore wall;

producing a rotor having a slot therethrough;

producing a vane having a centroid and two opposed tip regions;

slidably engaging the vane into the slot of the rotor; and rotatably fixing the rotor and slidably engaged vane into the bore about a central axis of the rotor such that the two opposed tip regions of the vane each have a contact point where the vane contacts the wall of the bore of the stator and such that the vane the centroid follows a circular path as the vane slidably moves within the slot of the rotor as the rotor rotates and induces the vane to slidably move within the slot under contact with the wall of the bore at the contact point of each of the two opposed tip regions;

wherein the two opposed tip regions are each a circular are having a common constant vane tip radius;

wherein the bore wall is defined by an x coordinate of $-(2*re+rR-rT)*\sin(\theta)-re*\sin(2*\theta)$ from the central axis added to an x radial offset of a circular rotor tip contact and a y coordinate of $(2*re+rR-rT)*\cos(\theta)+re*\cos(2*\theta)$ from the central axis added to a y radial offset of the circular rotor tip contact; and wherein re is a selected radius of eccentricity, rR is a rotor radius, rT is the common constant vane tip radius and $\theta$ is an angular position of the rotor swept through 360 degrees.

8. The method of claim 7, wherein the vane and the bore wall have a common height.

9. The method of claim 7, wherein the vane has a constant thickness along its length until the two opposed tip regions at each end.

10. The method of claim 7, wherein the rotor comprises a cylindrical surface with the central axis located within the bore such that the cylindrical surface contacts the bore wall at a point across the narrowest wall to wall measurement of the bore wall.

11. The method of claim 7, wherein a fluid is forced by the vane from an inlet in the wall of the bore to an outlet in the wall of the bore as the rotor rotates and drives the vane.

12. The method of claim 11, wherein a complete rotation of the rotor corresponds to both of the two opposed tip regions forcing fluid to the outlet.

* * * * *